US012163380B2

(12) United States Patent
Ota et al.

(10) Patent No.: US 12,163,380 B2
(45) Date of Patent: Dec. 10, 2024

(54) DRILLING BIT

(71) Applicant: MMC RYOTEC CORPORATION, Anpachi-gun (JP)

(72) Inventors: Hiroshi Ota, Anpachi-gun (JP); Taiyo Matsuse, Anpachi-gun (JP); Satoshi Ioka, Anpachi-gun (JP); Thanakrit Deatjirakarjornsakun, Anpachi-gun (JP)

(73) Assignee: MMC RYOTEC CORPORATION, Anpachi-gun (JP)

( * ) Notice: Subject to any disclaimer, the term of this patent is extended or adjusted under 35 U.S.C. 154(b) by 0 days.

(21) Appl. No.: 18/033,421

(22) PCT Filed: Oct. 19, 2021

(86) PCT No.: PCT/JP2021/038580
§ 371 (c)(1),
(2) Date: Apr. 24, 2023

(87) PCT Pub. No.: WO2022/091865
PCT Pub. Date: May 5, 2022

(65) Prior Publication Data

US 2023/0392448 A1 Dec. 7, 2023

(30) Foreign Application Priority Data

Oct. 28, 2020 (JP) ..... 2020-180553

(51) Int. Cl.
*E21B 10/38* (2006.01)
*E21B 10/52* (2006.01)

(52) U.S. Cl.
CPC ..... *E21B 10/38* (2013.01); *E21B 10/52* (2013.01)

(58) Field of Classification Search
CPC ..... E21B 10/52; E21B 10/38
See application file for complete search history.

(56) References Cited

U.S. PATENT DOCUMENTS 4,771,834 A 9/1988 Treitz
2007/0039761 A1* 2/2007 Cruz ..... E21B 10/38 175/420.1

(Continued)

FOREIGN PATENT DOCUMENTS

EP 0624708 A2 11/1994
EP 2592216 A1 5/2013

(Continued)

OTHER PUBLICATIONS

International Search Report mailed Nov. 22, 2021, issued for PCT/JP2021/038580 and English translation thereof.

(Continued)

*Primary Examiner* — Dany E Akakpo
(74) *Attorney, Agent, or Firm* — Locke Lord LLP

(57) ABSTRACT

This drilling bit includes a bit body centered on a tool central axis, a plurality of buttons protruding from a tip surface of the bit body, a discharge flow path disposed from the tip surface of the bit body over an outer peripheral surface, and a blow hole that extends inside the bit body and is open at the tip surface. The discharge flow path has a first flow path which has a groove shape located on the tip surface and extending in a tool radial direction, and at which the blow hole is open, and a second flow path located outward in the tool radial direction from the blow hole on the tip surface to communicate with the first flow path, and extending in a tool circumferential direction.

13 Claims, 8 Drawing Sheets

(56) References Cited

U.S. PATENT DOCUMENTS

| | | | |
|---|---|---|---|
| 2016/0348442 | A1 | 12/2016 | Rindeskar et al. |
| 2017/0268295 | A1* | 9/2017 | Rindeskär ..... E21B 10/36 |
| 2018/0066477 | A1 | 3/2018 | Hemph et al. |

FOREIGN PATENT DOCUMENTS

| | | | |
|---|---|---|---|
| EP | 3279425 | A1 | 2/2018 |
| JP | S62-502269 | A | 9/1987 |
| JP | 2016-196764 | A | 11/2016 |
| JP | 2020-111902 | A | 7/2020 |
| WO | 2015/113694 | A2 | 8/2015 |
| WO | 2019/002436 | A1 | 1/2019 |
| WO | 2020/043504 | A1 | 3/2020 |

OTHER PUBLICATIONS

Supplementary European Search Report mailed Jul. 22, 2024, issued for EP21885984.1.

* cited by examiner

DRILLING BIT

TECHNICAL FIELD

The present invention relates to a drilling bit.

Priority is claimed on Japanese Patent Application No. 2020-180553, filed Oct. 28, 2020, the content of which is incorporated herein by reference.

BACKGROUND ART

As a conventional drilling bit, for example, a drilling bit described in Patent Document 1 is known. The drilling bit includes a bit body centered on a tool central axis, a plurality of buttons protruding from a tip surface of the bit body, a discharge flow path disposed from the tip surface of the bit body over an outer peripheral surface, and a blow hole that extends inside the bit body and is open at the tip surface. In Patent Document 1, grooves extending in a tool radial direction and grooves extending in a tool circumferential direction are provided on the tip surface of the bit body as the discharge flow paths, and the blow holes are open at intersection parts (connecting parts) of these grooves. With this configuration, it is considered that a fluid such as water or compressed air flowing out from the blow hole is spread over a wide range on the tip surface of the bit body so that the dischargeability of cuttings (earth generated by crushing the ground and bedrock, muck) is enhanced.

CITATION LIST

Patent Document

[Patent Document 1]
PCT International Publication No. WO2015/113694

SUMMARY OF INVENTION

Technical Problem

However, in the conventional drilling bit, a flow velocity of the fluid flowing out from the blow hole tends to decrease, and there is room for improvement in terms of more efficient discharge of cuttings.

An object of the present invention is to provide a drilling bit capable of efficiently discharging cuttings while supplying a fluid to a wide range of a tip surface of a bit body.

Solution to Problem

According to one aspect of the present invention, a drilling bit includes a bit body centered on a tool central axis, a plurality of buttons (drilling tips) protruding from a tip surface of the bit body, a discharge flow path disposed from the tip surface of the bit body over an outer peripheral surface, and a blow hole that extends inside the bit body and is open at the tip surface. The discharge flow path has a first flow path which has a groove shape located on the tip surface and extending in a tool radial direction, and at which the blow hole is open, and a second flow path located outward in the tool radial direction from the blow hole on the tip surface to communicate with the first flow path, and extending in a tool circumferential direction.

With the drilling bit of the present invention, since the discharge flow path has the first flow path extending in the tool radial direction and the second flow path extending in the tool circumferential direction, a fluid can be spread over a wide range of the tip surface of the bit body.

Specifically, the second flow path is located outward in the tool radial direction from the blow hole. Therefore, the fluid flowing out from the blow hole into the first flow path flows along the first flow path in the tool radial direction, and then flows into the second flow path to also flow in the tool circumferential direction. In this way, the fluid flowing out from the blow hole into the first flow path first flows outward in the tool radial direction, so that a decrease in the flow velocity of the fluid is restrained and the force pushing out cuttings toward the rear end side of the bit body is stably increased. Accordingly, it is possible to efficiently and stably discharge cuttings.

In addition, according to the present invention, since cuttings can be efficiently discharged, the friability of the button, that is, the drilling performance, is well maintained. Specifically, for example, the present invention restrains a defect such as secondary crushing caused by the crushed cuttings remaining at the tip of the bit as in the conventional art. Therefore, the drilling speed can be improved, and the drilling distance per unit time can be extended. As a result, it is possible to extend the time (distance) in which the drilling bit can drill before the drilling bit reaches its fatigue limit, that is, it is possible to extend the tool life.

In the drilling bit, the second flow path may extend from a connection part with the first flow path toward at least an opposite side of a tool rotation direction in the tool circumferential direction.

In this case, when the drilling bit is rotated in the tool rotation direction around the tool central axis during drilling, the fluid flowing through the second flow path tends to flow toward the opposite side of the tool rotation direction, that is, in a direction away from the first flow path in the tool circumferential direction. Therefore, it is possible to discharge cuttings more efficiently.

In the drilling bit, the discharge flow path may have a third flow path that has a groove shape located on the outer peripheral surface and extending in a tool axial direction, and that is connected to an outer end part of the first flow path in the tool radial direction.

In this case, the fluid flowing outward in the tool radial direction through the first flow path flows toward the rear end side of the bit body through the third flow path. Since a decrease in the flow velocity of the fluid flowing toward the rear end side of the bit body in the discharge flow path is restrained, the force pushing out cuttings toward the rear end side is well maintained, and the dischargeability of cuttings is stably enhanced.

In the drilling bit, the tip surface may have a face surface facing a tip side in a tool axial direction, and a gauge surface that is disposed outward in the tool radial direction from the face surface, and that is located on a rear end side in the tool axial direction while extending outward in the tool radial direction. The plurality of buttons may include a face tip disposed on the face surface, and a gauge tip disposed on the gauge surface, and the blow hole may be located inward in the tool radial direction or overlap with respect to a rotational trajectory of the face tip around the tool central axis when viewed from the tool axial direction.

In this case, cuttings generated by the drilling of the face tip easily flow outward in the tool radial direction because of the fluid flowing out from the blow hole. Therefore, the defect such as cuttings remaining at the tip of the bit is restrained.

In a case where the rotational trajectory of the face tip around the tool central axis and the blow hole overlap with each other, the face tip restrains the fluid flowing out from the blow hole from flowing into the tool circumferential direction immediately after the flow-out. Therefore, the fluid flowing from the blow hole in the tool radial direction flows more stably, and the flow velocity of the fluid is increased.

In the drilling bit, the tip surface may have a face surface facing a tip side in a tool axial direction, and a gauge surface that is disposed outward in the tool radial direction from the face surface, and that is located on a rear end side in the tool axial direction while extending outward in the tool radial direction. The plurality of buttons may include a face tip disposed on the face surface, and a plurality of gauge tips disposed on the gauge surface. The gauge surface may have a plurality of bearing surfaces arranged in the tool circumferential direction, the gauge tip may be provided on each of the bearing surfaces, the bearing surface may be located on the rear end side in the tool axial direction while extending toward one side in the tool circumferential direction, and the second flow path may be located on the bearing surface and may extend from a connection part with the first flow path toward the other side in the tool circumferential direction.

In this case, since the bearing surface on which the gauge tip is disposed also functions as the second flow path, the above-described effect of the present invention can be obtained while simplifying the structure of the tip surface of the bit body.

In the drilling bit, among the plurality of the buttons, a tip central axis of a predetermined button adjacent to the first flow path in the tool circumferential direction may be away from the first flow path in the tool circumferential direction while extending toward a rear end side in a tool axial direction.

In the present invention, there is a probability of premature wear in the vicinity of the first flow path because the flow velocity of the fluid flowing through the first flow path is increased. In that respect, the above configuration is employed, so that a large wall thickness is ensured between a predetermined button adjacent to the first flow path and the first flow path, and the button is restrained from falling off from the bit body because of the wear in the vicinity of the first flow path.

In the drilling bit, the tip surface may have a face surface facing a tip side in a tool axial direction, and a gauge surface that is disposed outward in the tool radial direction from the face surface, and that is located on a rear end side in the tool axial direction while extending outward in the tool radial direction, the plurality of buttons may include a face tip disposed on the face surface, and a gauge tip disposed on the gauge surface, and a tip central axis of the gauge tip may extend toward an opposite side of a tool rotation direction in the tool circumferential direction while extending toward the rear end side in the tool axial direction.

In this case, during drilling, the gauge tip can receive and relax a bending stress applied onto the gauge tip due to the rotational force in the tool rotation direction as a compressive stress in the tip axial direction. Therefore, breakage of the gauge tip or the like is restrained.

In the drilling bit, the tip surface may have a face surface facing a tip side in a tool axial direction, and a gauge surface that is disposed outward in the tool radial direction from the face surface, and that is located on a rear end side in the tool axial direction while extending outward in the tool radial direction, the plurality of buttons may include a face tip disposed on the face surface, and a gauge tip disposed on the gauge surface, and a tip central axis of the face tip may extend toward an opposite side of a tool rotation direction in the tool circumferential direction while extending toward the rear end side in the tool axial direction.

In this case, during drilling, the face tip can receive and relax a bending stress applied onto the face tip due to the rotational force in the tool rotation direction as a compressive stress in the tip axial direction. Therefore, breakage of the face tip or the like is restrained.

In the drilling bit, the button may have a convexly curved impact edge (top of button) disposed at a tip part in a tip axial direction, and a radius of curvature of the impact edge may be less than ½ of an outer diameter dimension of the button.

In this case, the button is a so-called spike tip or the like. That is, since a tip part of the button is convexly formed, the drilling speed can be further increased. In addition, the button has a sharp shape, so that a space for the fluid to flow in the vicinity of the tip part of the button is ensured, and the dischargeability of cuttings can be further enhanced.

In the drilling bit, the discharge flow path may have a fourth flow path that has a groove shape located on the outer peripheral surface and extending in a tool axial direction, and that communicates with the second flow path.

In this case, the fluid flowing through the second flow path flows toward the rear end side of the bit body through the fourth flow path. Therefore, the dischargeability of cuttings can be further enhanced.

In the drilling bit, the first flow path may have a flow velocity increasing part that is disposed outward in the tool radial direction from the blow hole, and that has a groove width which narrows while extending outward in the tool radial direction.

In this case, the fluid flowing out from the blow hole into the first flow path flows outward in the tool radial direction through the flow velocity increasing part, so that the flow velocity is further increased. Therefore, the dischargeability of cuttings can be stably enhanced.

In the drilling bit, the first flow path may have a flow rate increasing part that has a groove width which widens while extending outward in the tool radial direction, and the blow hole may be open at the flow rate increasing part.

In this case, the fluid immediately after flowing out from the blow hole into the flow rate increasing part tends to flow in a direction in which the groove width is wide, that is, outward in the tool radial direction. That is, since, in the fluid flowing out from the blow hole into the flow rate increasing part, a flow rate of a fluid flowing outward in the tool radial direction is larger than a flow rate of a fluid flowing inward in the tool radial direction, the fluid as a whole tends to flow outward in the tool radial direction. Therefore, the fluid in the first flow path can stably flow outward in the tool radial direction, and the dischargeability of cuttings can be enhanced.

In the drilling bit, a plurality of the first flow paths may be provided side by side in the tool circumferential direction, and the plurality of first flow paths may be connected to each other via an inner end part of each of the first flow paths in the tool radial direction.

In this case, the dischargeability of cuttings can be stably enhanced even in the vicinity of the center part (on the tool central axis) of the tip surface of the bit body.

Advantageous Effects of Invention

With the drilling bit of one aspect of the present invention, it is possible to efficiently discharge cuttings while supplying the fluid to a wide range of the tip surface of the bit body.

DESCRIPTION OF EMBODIMENTS

Figure 1:
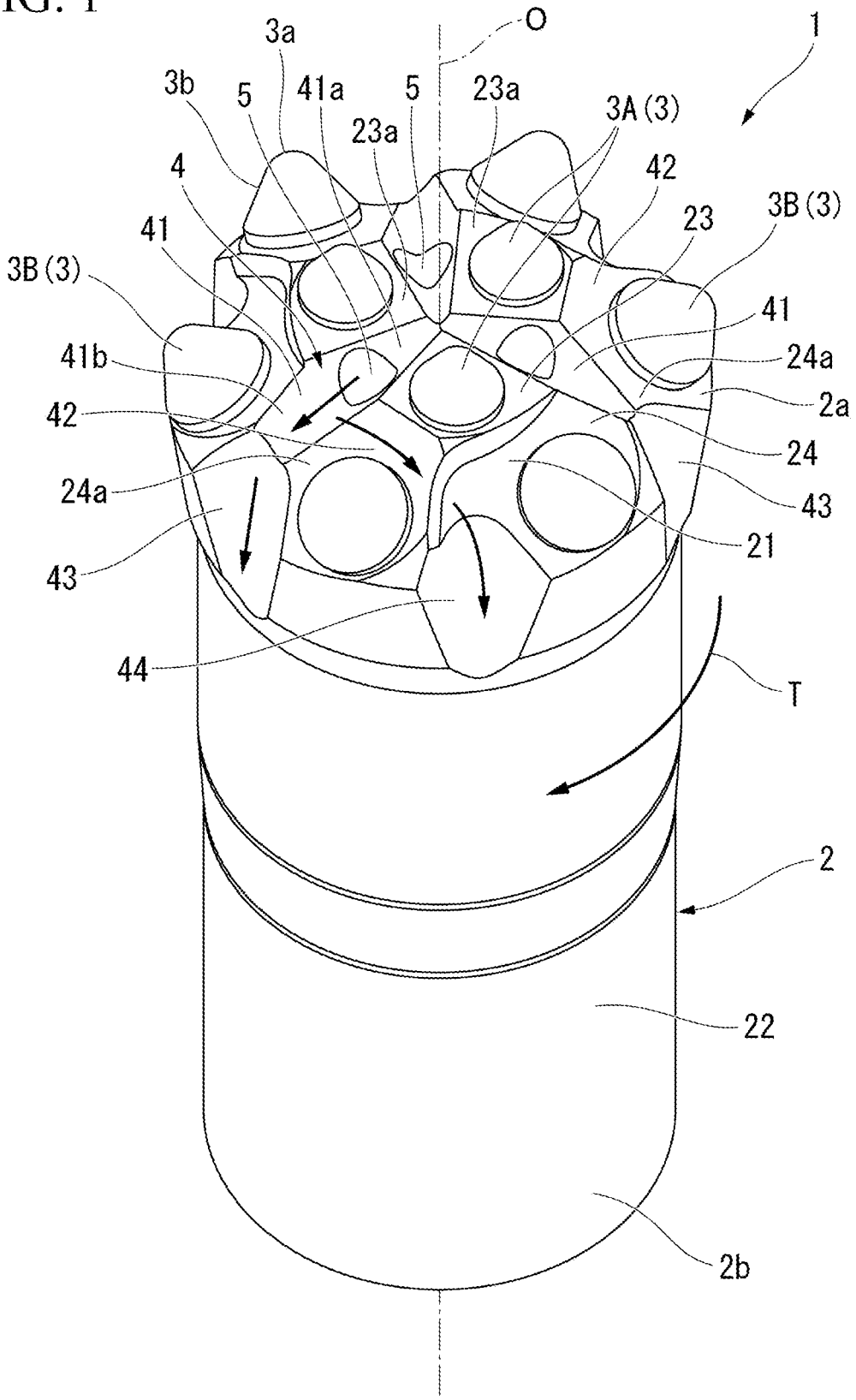
FIG. 1 is a perspective view showing a drilling bit of the present embodiment.

A drilling bit 1 according to one embodiment of the present invention will be described with reference to the drawings.

The drilling bit 1 of the present embodiment is connected to a drilling device, such as a drifter, via an extension rod (not shown), and is used to drill the ground or bedrock, that is, to form a drilling hole.

As shown in FIGS. 1 to 4, the drilling bit 1 includes a columnar bit body 2 centered on a tool central axis O, and a columnar button (drilling tip) 3, a blow hole 5, and a discharge flow path 4 that are disposed on, among both end parts (a first end part 2*a* and a second end part 2*b*) of the bit body 2, the first end part 2*a* and that are provided at rotationally symmetric positions centered on a tip central axis C.

Definition of Direction

In the present embodiment, a direction in which the tool central axis O of the bit body 2 extends is referred to as a tool axial direction. In the tool axial direction, a direction from the second end part 2*b* toward the first end part 2*a* of the bit body 2 is referred to as a tip side in the tool axial direction or simply the tip side, and a direction from the first end part 2*a* toward the second end part 2*b* is referred to as a rear end side in the tool axial direction or simply the rear end side.

A direction orthogonal to the tool central axis O is referred to as a tool radial direction. In the tool radial direction, a direction approaching the tool central axis O is referred to as an inside in the tool radial direction, and a direction away from the tool central axis O is referred to as an outside in the tool radial direction.

A direction rotating around the tool central axis O is referred to as a tool circumferential direction. In the tool circumferential direction, a direction in which the drilling bit 1 is rotated by the drilling device and the extension rod during drilling is referred to as a tool rotation direction T, and a rotation direction opposite to this is referred to as an opposite side of the tool rotation direction T or simply counter-tool rotation direction. In the present embodiment, one side in the tool circumferential direction corresponds to the tool rotation direction T, and the other side in the tool circumferential direction corresponds to the counter-tool rotation direction.

Further, a direction in which the tip central axis C of the button 3 extends is referred to as a tip axial direction. One end part of the button 3 protrudes from the surface of the bit body 2, and the other end part thereof is embedded inside the bit body 2. In the present embodiment, in the tip axial direction, a direction from the other end part toward the one end part of the button 3 is referred to as a tip side of the tip axial direction, and a direction from the one end part toward the other end part is referred to as a rear end side of the tip axial direction.

A direction orthogonal to the tip central axis C is referred to as a tip radial direction.

A direction rotating around the tip central axis C is referred to as a tip circumferential direction.

[Bit Body]

Figure 3:
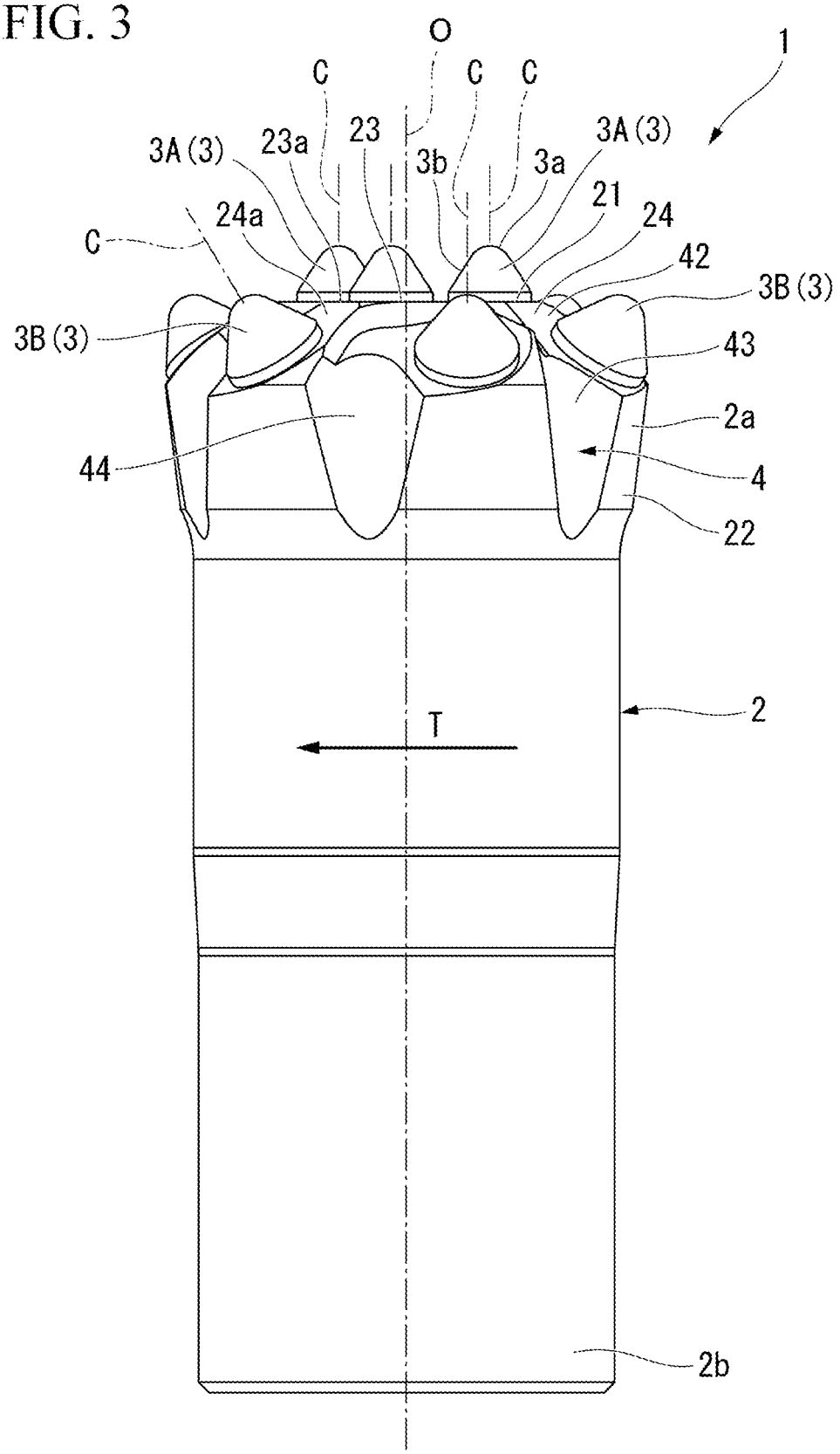
FIG. 3 is a side view showing the drilling bit in FIG. 2 as viewed from an arrow III.
Figure 4:
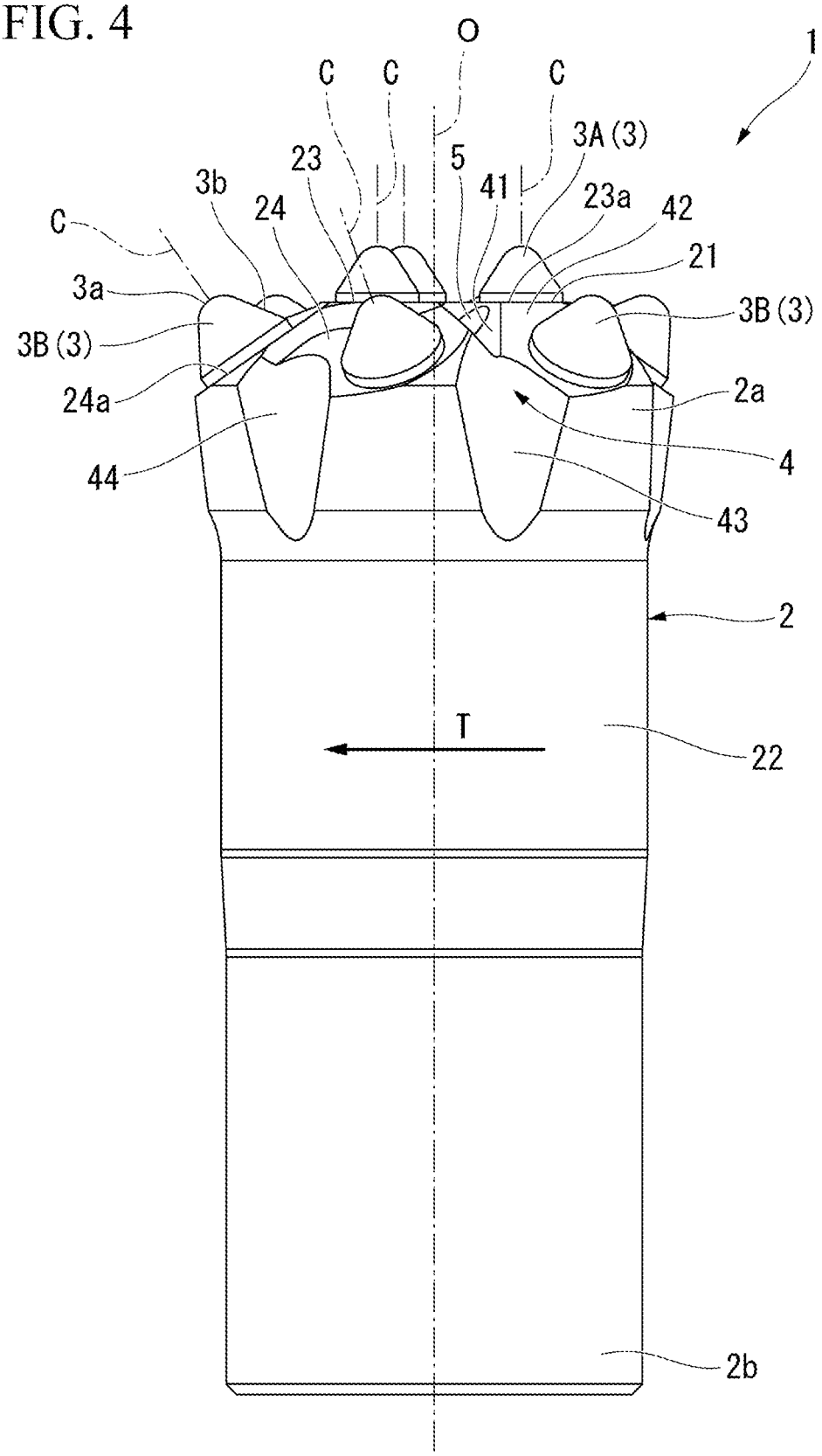
FIG. 4 is a side view of the drilling bit in FIG. 2 as viewed from an arrow IV.
Figure 5:
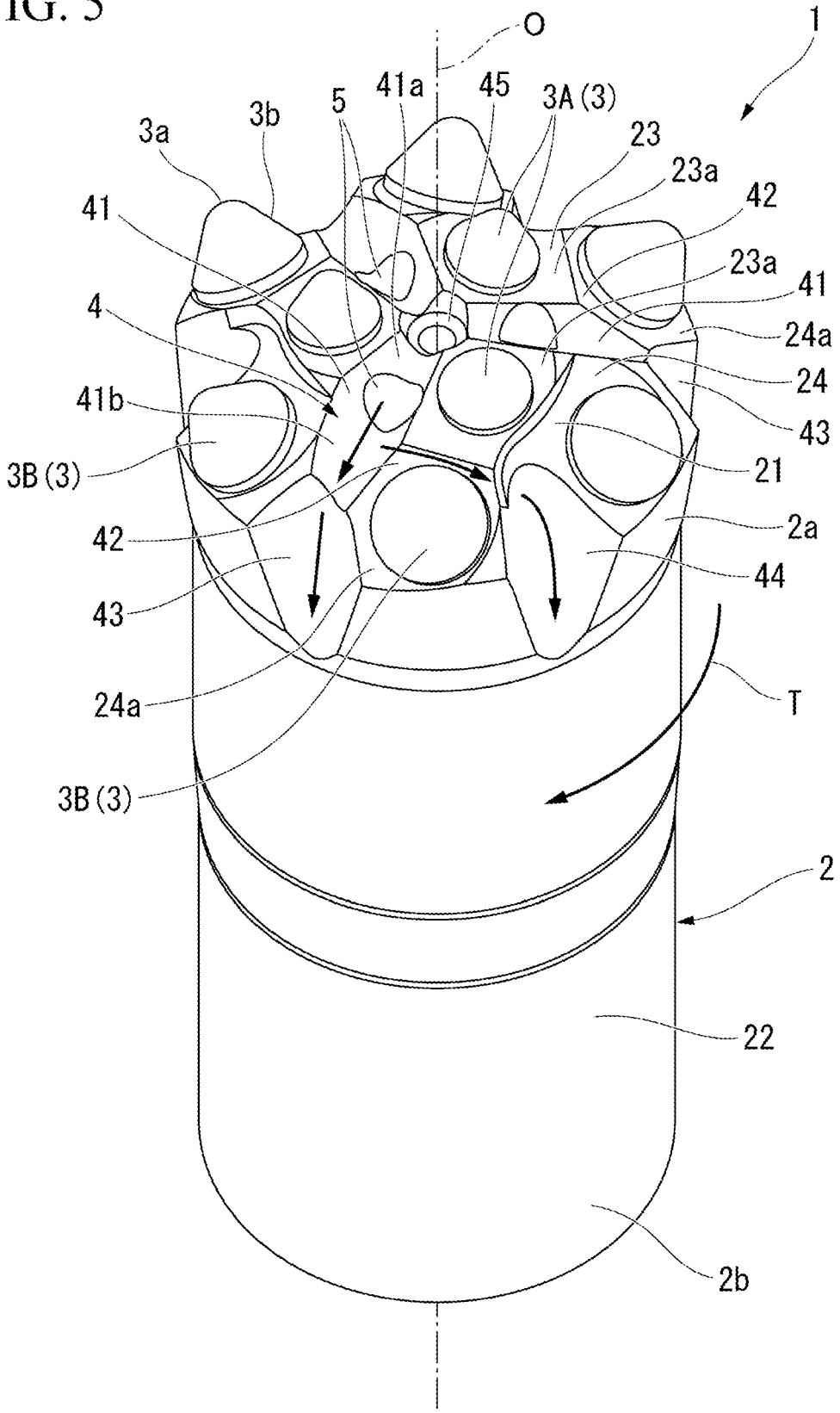
FIG. 5 is a perspective view showing a drilling bit of a modification example of the present embodiment.
Figure 6:
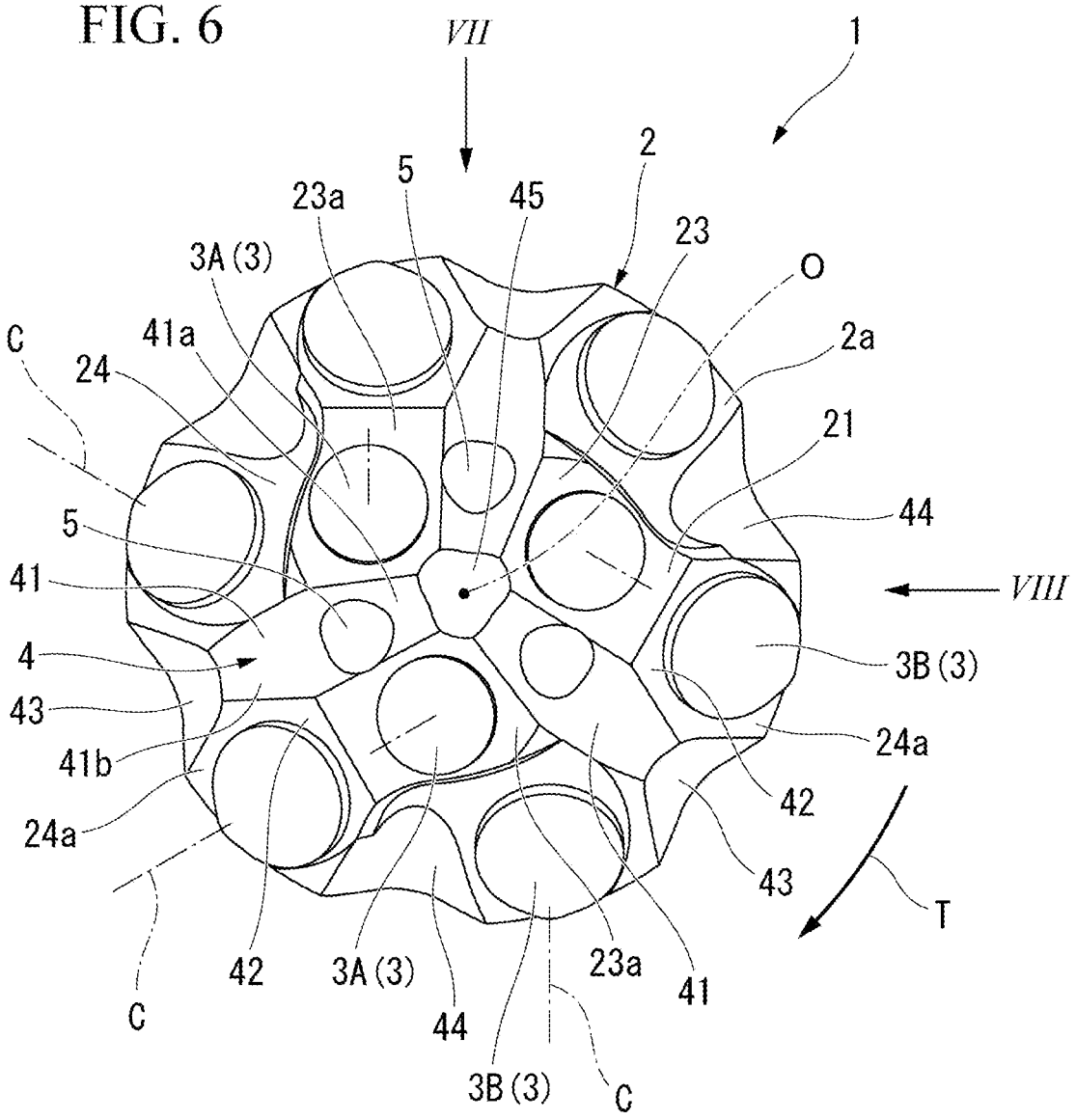
FIG. 6 is a front view showing the drilling bit of the modification example of the present embodiment.
Figure 7:
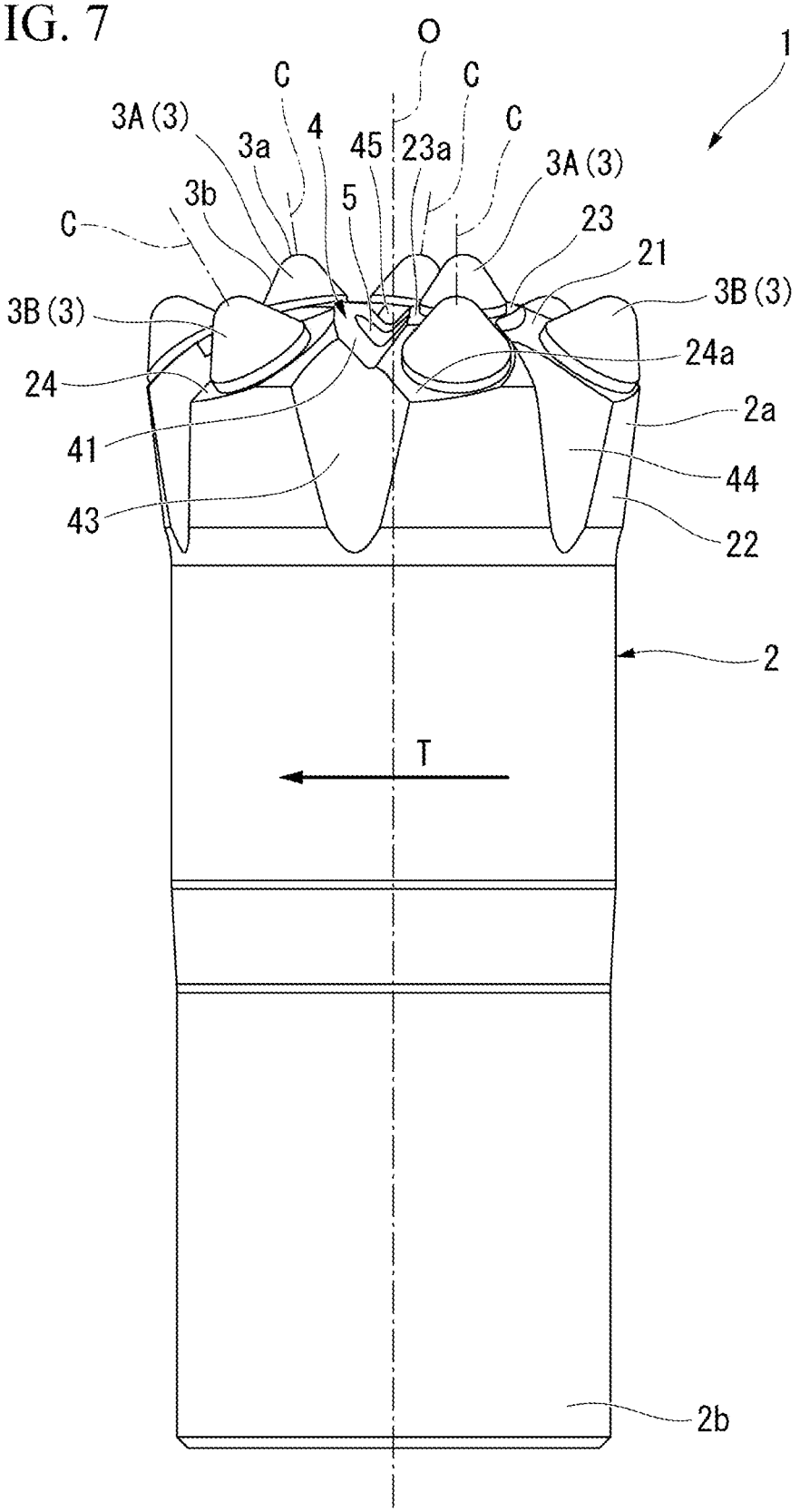
FIG. 7 is a side view showing the drilling bit in FIG. 6 as viewed from an arrow VII.
Figure 8:
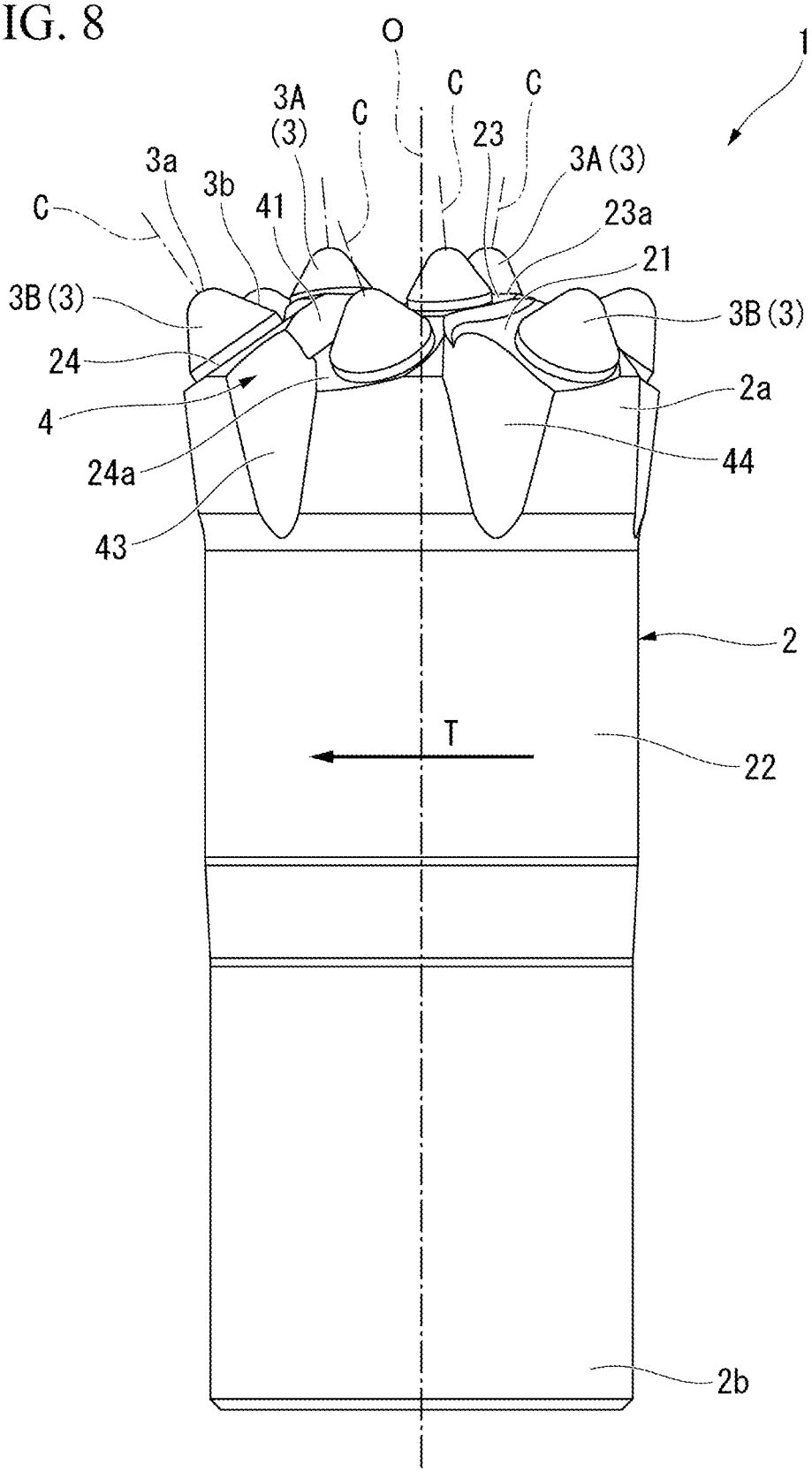
FIG. 8 is a side view showing the drilling bit in FIG. 6 as viewed from an arrow VIII.

The bit body 2 is made of, for example, steel. The bit body 2 has a cylindrical shape extending in the tool axial direction. As shown in FIGS. 3 and 4, the first end part 2*a* of the bit body 2, that is, a tip part, has a larger outer diameter than a part other than the tip part. Although not particularly shown, the bit body 2 has a female screw hole that is open at an end surface facing the rear end side in the tool axial direction, that is, at a rear end surface, and that extends coaxially in the tool axial direction. The female screw hole is disposed in a part other than the first end part 2*a* of the bit body 2, that is, in a part other than the tip part. With this configuration, it can also be said that the bit body 2 has a bottomed cylindrical shape that is open to the rear end side in the tool axial direction.

Although not particularly shown, a male screw at a tip part of the extension rod is screwed into the female screw hole of the bit body 2. A rotational force around the tool central axis O, and a thrust force and an impact force toward the tip side in the tool axial direction are transmitted from the drilling device to the bit body 2 via the extension rod. With this, the drilling bit 1 can advance while crushing the ground or bedrock to form a drilling hole. Further, a fluid, such as water or compressed air, is supplied to the inside of the bit body 2 (into the female screw hole) via the extension rod or the like having a flow path therein.

The bit body 2 has a tip surface 21 and an outer peripheral surface 22.

The tip surface 21 has a face surface 23 facing the tip side in the tool axial direction, and a gauge surface 24 that is disposed outward in the tool radial direction from the face surface 23 and that is located on the rear end side in the tool axial direction while extending outward in the tool radial direction. That is, the gauge surface 24 faces the tip side in the tool axial direction and the outside in the tool radial direction.

Figure 2:
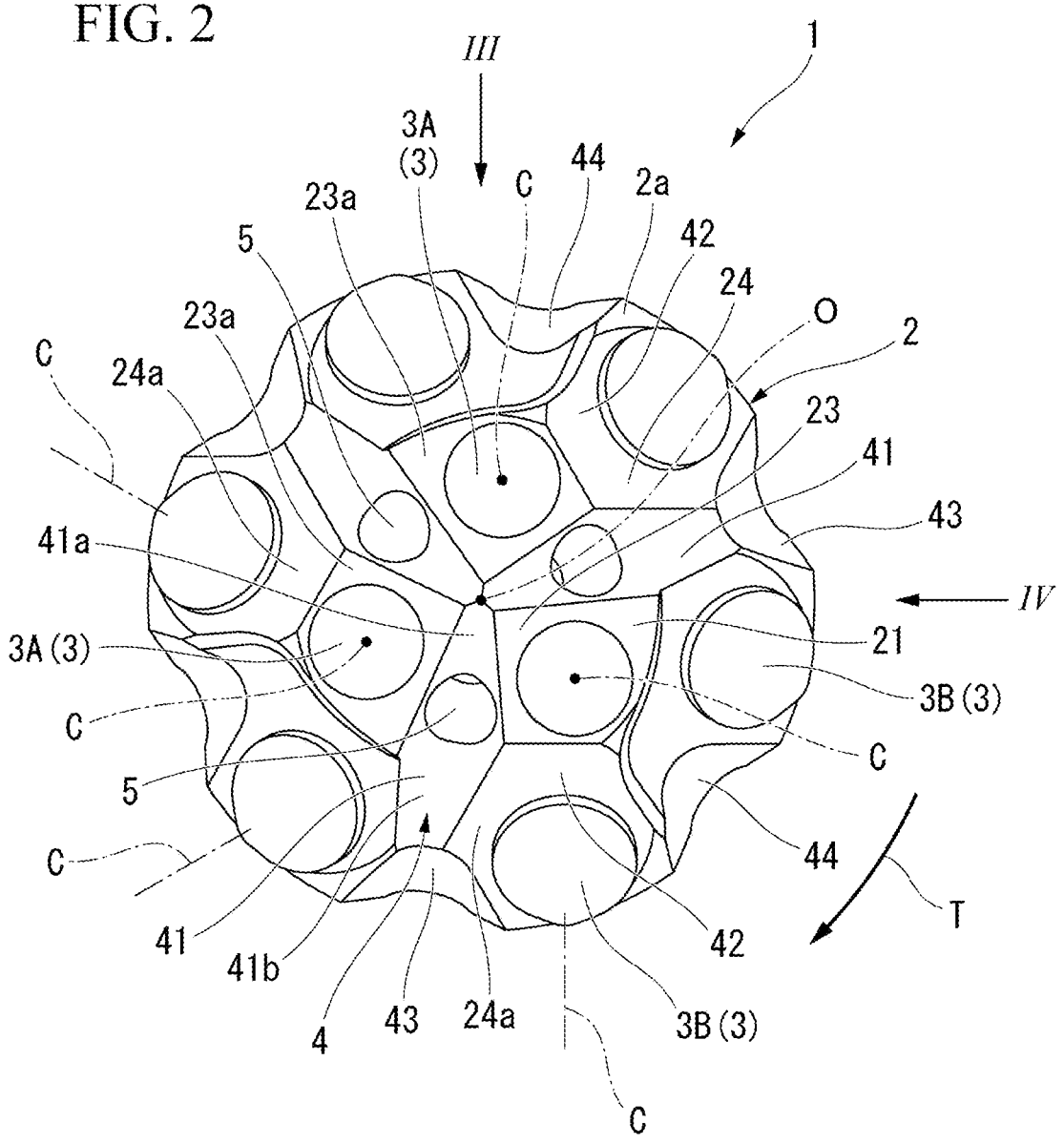
FIG. 2 is a front view showing the drilling bit of the present embodiment.

As shown in FIGS. 1 and 2, the face surface 23 has a plurality of front surfaces 23*a* arranged in the tool circumferential direction. In the present embodiment, three front surfaces 23*a* are provided side by side along the face surface 23 at intervals of 120° in the tool circumferential direction about the tool central axis O. As shown in FIGS. 3 and 4, the front surface 23*a* is a plane expanding in a direction perpendicular to the tool central axis O. A circular mounting hole (not shown) is open in each front surface 23*a*. Each mounting hole extends in a direction orthogonal to the front surface 23*a*, that is, in parallel with the tool central axis O (in the tool axial direction).

As shown in FIGS. 1 and 2, the gauge surface 24 has a plurality of gauge surfaces (bearing surfaces) 24*a* arranged in the tool circumferential direction. In the present embodiment, six gauge surfaces 24*a* are provided side by side along the gauge surface 24 in the tool circumferential direction at intervals of approximately 60°. The gauge surface 24*a* is a plane facing the tip side in the tool axial direction and the outside in the tool radial direction (that is, facing a middle direction between the tip side in the tool axial direction and the outside in the tool radial direction). The gauge surface 24*a* is an inclined surface located on the rear end side in the tool axial direction while extending toward one side in the tool circumferential direction, that is, in the tool rotation direction T. Further, the gauge surface 24*a* is also an inclined surface located inward in the tool radial direction while extending in the tool rotation direction T. A circular mounting hole (not shown) is open in each gauge surface 24*a*. Each mounting hole extends in a direction orthogonal to the gauge surface 24*a*, that is, in a direction inclined with respect to the tool central axis O. Specifically, a central axis of each mounting hole and the tool central axis O are at a skew position.

As shown in FIGS. 3 and 4, a tip part of the outer peripheral surface 22 has a larger outer diameter than the part other than the tip part. The tip part of the outer peripheral surface 22 has a tapered shape in which the outer diameter increases while extending toward the tip side in the tool axial direction. The tip part of the outer peripheral surface 22 is connected to an outer end part of the gauge surface 24 in the tool radial direction.

[Button]

The button 3 is made of, for example, cemented carbide. The button 3 may be coated with a hard layer made of sintered polycrystalline diamond or the like at the tip part in the tip axial direction.

The button 3 protrudes from the tip surface 21 of the bit body 2. A plurality of the buttons 3 are provided on the tip surface 21. Each button 3 is fixed to each mounting hole of the front surface 23*a* and the gauge surface 24*a* by interference fitting, such as press fitting or shrink fitting, or by brazing. The tip central axis C of each button 3 extends in a direction orthogonal to the front surface 23*a* or the gauge surface 24*a* on which each button 3 is disposed.

Specifically, the tip part of the button 3 in the tip axial direction protrudes from the tip surface 21 of the bit body 2 and is exposed to the outside. Although not particularly shown, a part of the button 3 other than the tip part in the tip axial direction is embedded into the mounting hole. The tip part of the button 3 in the tip axial direction has an outer diameter that decreases while extending toward the tip side in the tip axial direction. The part of the button 3 other than the tip part in the tip axial direction has a cylindrical shape with a constant outer diameter along the tip axial direction.

The button 3 of the present embodiment is a so-called spike tip having a substantially conical tip part in the tip axial direction.

The button 3 has a convexly curved impact edge 3*a* disposed at the tip part in the tip axial direction, and a tapered part 3*b* disposed at the tip part in the tip axial direction and located on the rear end side in the tip axial direction with respect to the impact edge 3*a*.

The impact edge 3*a* is located at the leading tip of the button 3 in the tip axial direction. The impact edge 3*a* has a substantially hemispherical shape. For example, in a vertical cross-sectional view of the button 3 including the tip central axis C, the radius of curvature of the impact edge 3*a* is less than ½ of the outer diameter dimension of the button 3 (diameter dimension in the tip radial direction). The outer diameter dimension of the button 3 indicates an outer diameter dimension of the maximum diameter part of the button 3 and, specifically, is an outer diameter dimension of the part (the cylindrical part) of the button 3 other than the tip part.

The tapered part 3*b* is connected to a rear end part of the impact edge 3*a* in the tip axial direction. The tapered part 3*b* has a tapered shape in which the outer diameter increases while extending toward the rear end side in the tip axial direction.

As shown in FIG. 1, the plurality of buttons 3 include a face tip 3A disposed on the face surface 23 and a gauge tip 3B disposed on the gauge surface 24. In the present embodiment, the outer diameter dimension of the gauge tip 3B is larger than the outer diameter dimension of the face tip 3A. In addition, an amount of protrusion of the gauge tip 3B in which the tip part thereof in the tip axial direction protrudes from the gauge surface 24 is larger than an amount of protrusion of the face tip 3A in which the tip part thereof in the tip axial direction protrudes from the face surface 23.

A plurality of the face tips 3A are provided on the face surface 23. That is, the plurality of buttons 3 include the plurality of face tips 3A. In the present embodiment, three face tips 3A are provided side by side on the face surface 23 in the tool circumferential direction. The face tip 3A is provided on each front surface 23*a*. In the present embodiment, one face tip 3A is disposed for one front surface 23*a*. As shown in FIGS. 2 to 4, the tip central axis C of the face tip 3A extends in the tool axial direction.

As shown in FIG. 1, a plurality of the gauge tips 3B are provided on the gauge surface 24. That is, the plurality of buttons 3 include the plurality of gauge tips 3B. In the present embodiment, six gauge tips 3B are provided side by side on the gauge surface 24 in the tool circumferential direction. The gauge tip 3B is provided on each gauge surface 24*a*. In the present embodiment, one gauge tip 3B is disposed for one gauge surface 24*a*. As shown in FIGS. 2 to 4, the tip central axis C of the gauge tip 3B extends inward in the tool radial direction while extending toward the rear end side in the tool axial direction. The tip central axis C of the gauge tip 3B extends toward the opposite side of the tool rotation direction T in the tool circumferential direction while extending toward the rear end side in the tool axial direction.

[Blow Hole]

As shown in FIGS. 1 and 2, the blow hole 5 extends inside the bit body 2 and is open at the tip surface 21. The blow hole 5 has a circular hole shape. The blow hole 5 is located inward in the tool radial direction while extending from the tip surface 21 of the bit body 2 toward the rear end side in the tool axial direction. That is, the blow hole 5 extends obliquely with respect to the tool central axis O. Although not particularly shown, the blow hole 5 communicates with the inside of the female screw hole of the bit body 2.

When viewed from the tool axial direction, the blow hole 5 is located inward in the tool radial direction or overlaps with respect to the rotational trajectory (not shown) of the face tip 3A around the tool central axis O. In the present embodiment, as shown in FIG. 2, when viewed from the tool axial direction, the rotational trajectory of the face tip 3A around the tool central axis O and the blow hole 5 overlap with each other.

A plurality of the blow holes 5 are provided. In the present embodiment, three blow holes 5 are provided side by side in the tool circumferential direction, and each blow hole 5 is formed between two adjacent face tips 3A.

[Discharge Flow Path]

As shown in FIGS. 1 and 2, the discharge flow path 4 is disposed from the tip surface 21 over the outer peripheral surface 22 of the bit body 2. The discharge flow path 4 extends from the tip surface 21 of the bit body 2 over the tip part of the outer peripheral surface 22. A fluid is supplied from the inside of the bit body 2 to the discharge flow path 4 through the blow hole 5. The discharge flow path 4 is a flow path for sending cuttings to the rear end side of the bit body 2 by causing the cuttings generated by crushing the ground or bedrock by the button 3 to flow to the outer peripheral surface 22 together with the fluid from the tip surface 21 of the bit body 2.

The discharge flow path 4 has a first flow path 41, a second flow path 42, a third flow path 43, and a fourth flow path 44. The discharge flow path 4 has a plurality of sets of the first flow path 41, the second flow path 42, the third flow path 43, and the fourth flow path 44. In the present embodiment, three sets of the first flow path 41, the second flow path 42, the third flow path 43, and the fourth flow path 44 are provided side by side in the tool circumferential direction. That is, a plurality of first flow paths 41, a plurality of second flow paths 42, a plurality of third flow paths 43, and a plurality of fourth flow paths 44 are each (three each) provided side by side in the tool circumferential direction.

The first flow path 41 has a groove shape located on the tip surface 21 and extending in the tool radial direction, and the blow hole 5 is open in the middle of the first flow path 41. The first flow path 41 is disposed in the tool radial direction between a pair of face tips 3A and 3A adjacent in the tool circumferential direction and between a pair of gauge tips 3B and 3B adjacent in the tool circumferential direction. The first flow path 41 extends in the tool radial direction between a pair of front surfaces 23*a* and 23*a* adjacent in the tool circumferential direction and between a pair of gauge surfaces 24*a* and 24*a* adjacent in the tool circumferential direction. Specifically, the first flow path 41 is located on the rear end side in the tool axial direction while extending outward in the tool radial direction. Although not particularly shown, a groove bottom of the first flow path 41 extends linearly in a vertical cross-sectional view including the tool central axis O.

Among the plurality of the buttons 3, the tip central axis C of a predetermined button 3 adjacent to the first flow path 41 in the tool circumferential direction is away from the first flow path 41 in the tool circumferential direction while extending toward the rear end side in the tool axial direction. Specifically, in the present embodiment, among the plurality of buttons 3, the tip central axis C of a predetermined gauge tip 3B adjacent to the first flow path 41 in the counter-tool rotation direction is away from the first flow path 41 in the counter-tool rotation direction while extending toward the rear end side in the tool axial direction.

The first flow path 41 has a flow rate increasing part 41*a* and a flow velocity increasing part 41*b*.

The flow rate increasing part 41*a* is disposed on an inner part of the first flow path 41 in the tool radial direction. The flow rate increasing part 41*a* has a groove width that widens while extending outward in the tool radial direction. The blow hole 5 is open at the flow rate increasing part 41*a*.

The flow velocity increasing part 41*b* is disposed on an outer part of the first flow path 41 in the tool radial direction. The flow velocity increasing part 41*b* has a groove width that narrows while extending outward in the tool radial direction. The flow velocity increasing part 41*b* is disposed outward in the tool radial direction from the blow hole 5.

The flow velocity increasing part 41*b* has a pair of groove walls facing each other in the tool circumferential direction. Among the pair of groove walls, a height in the tool axial direction of one groove wall that is located at an end part of the flow velocity increasing part 41*b* in the counter-tool rotation direction to face the tool rotation direction T is lower than a height in the tool axial direction of the other groove wall that is located at an end part of the flow velocity increasing part 41*b* in the tool rotation direction T to face the counter-tool rotation direction. Therefore, some of the fluid flowing through the flow velocity increasing part 41*b* flows over the one groove wall onto the gauge surface 24*a* adjacent to the flow velocity increasing part 41*b* in the counter-tool rotation direction.

The plurality of first flow paths 41 are connected to each other via an inner end part of each first flow path 41 in the tool radial direction. In the present embodiment, the inner end parts of the flow rate increasing parts 41*a* of the three first flow paths 41 in the tool radial direction are directly connected to each other. The plurality of first flow paths 41 communicate with each other through the tool central axis O.

The second flow path 42 is located outward in the tool radial direction from the blow hole 5 on the tip surface 21 to communicate with the first flow path 41, and extends in the tool circumferential direction. The second flow path 42 extends from a connection part with the first flow path 41 toward at least the opposite side of the tool rotation direction T in the tool circumferential direction. In the present embodiment, the second flow path 42 includes the gauge surface 24*a* adjacent to the flow velocity increasing part 41*b* of the first flow path 41 in the counter-tool rotation direction. That is, the second flow path 42 is located on the gauge surface 24*a* and extends from the connection part with the first flow path 41 toward the other side in the tool circumferential direction, that is, in the counter-tool rotation direction. The second flow path 42 may extend across a plurality (two) of gauge surfaces 24*a* located between a pair of first flow paths 41 and 41 adjacent in the tool circumferential direction.

The third flow path 43 has a groove shape located on the outer peripheral surface 22 and extending in the tool axial direction, and is connected to the outer end part of the first flow path 41 in the tool radial direction. The third flow path 43 is disposed at the tip part of the outer peripheral surface 22, and the tip part of the third flow path 43 in the tool axial direction is open at the tip surface 21. Specifically, the third flow path 43 is connected to the outer end part of the flow velocity increasing part 41*b* in the tool radial direction and is open at the gauge surface 24. The third flow path 43 is located between the pair of gauge tips 3B and 3B in the tool circumferential direction. The groove width of the third flow path 43 is greater than or equal to the groove width of the first flow path 41. The groove bottom of the third flow path 43 is located outward in the tool radial direction while extending toward the rear end side in the tool axial direction. That is, the groove depth of the third flow path 43 becomes shallower while extending toward the rear end side in the tool axial direction.

The fourth flow path 44 has a groove shape located on the outer peripheral surface 22 and extending in the tool axial direction, and communicates with the second flow path 42. The fourth flow path 44 is disposed at the tip part of the outer peripheral surface 22, and the tip part of the fourth flow path 44 in the tool axial direction is open at the tip surface 21. Specifically, the fourth flow path 44 is open at the gauge surface 24. The fourth flow path 44 is located between the pair of gauge tips 3B and 3B in the tool circumferential direction. The fourth flow path 44 is located in the counter-tool rotation direction of the first flow path 41 and the third flow path 43. The groove width of the fourth flow path 44 is greater than or equal to the groove width of the first flow path 41. In the present embodiment, the groove width of the fourth flow path 44 and the groove width of the third flow path 43 are substantially the same as each other. The groove bottom of the fourth flow path 44 is located outward in the tool radial direction while extending toward the rear end side in the tool axial direction. That is, the groove depth of the fourth flow path 44 becomes shallower while extending toward the rear end side in the tool axial direction.

Effects of Present Embodiment

With the drilling bit 1 of the present embodiment described above, since the discharge flow path 4 has the first flow path 41 extending in the tool radial direction and the second flow path 42 extending in the tool circumferential direction, a fluid can be spread over a wide range of the tip surface 21 of the bit body 2.

Specifically, the second flow path 42 is located outward in the tool radial direction from the blow hole 5. Therefore, the fluid flowing out from the blow hole 5 into the first flow path 41 flows along the first flow path 41 in the tool radial direction, and then flows into the second flow path 42 to also flow in the tool circumferential direction. In this way, the fluid flowing out from the blow hole 5 into the first flow path 41 first flows outward in the tool radial direction, so that a decrease in the flow velocity of the fluid is restrained and the force pushing out cuttings toward the rear end side of the bit body 2 is stably increased. Accordingly, it is possible to efficiently and stably discharge cuttings.

In addition, according to the present embodiment, since cuttings can be efficiently discharged, the friability of the button 3, that is, the drilling performance, is well maintained. Specifically, for example, the present embodiment restrains the defect such as secondary crushing of cuttings caused by the crushed cuttings remaining at the tip of the bit as in the conventional art. Therefore, the drilling speed can be improved, and the drilling distance per unit time can be extended. As a result, it is possible to extend the time (distance) in which the drilling bit 1 can drill before the drilling bit reaches its fatigue limit, that is, it is possible to extend the tool life.

Further, in the present embodiment, the second flow path 42 extends from the connection part with the first flow path 41 toward at least the opposite side of the tool rotation direction T in the tool circumferential direction.

In this case, when the drilling bit 1 is rotated in the tool rotation direction T around the tool central axis O during drilling, the fluid flowing through the second flow path 42 tends to flow toward the opposite side of the tool rotation direction T, that is, in a direction away from the first flow path 41 in the tool circumferential direction. Therefore, it is possible to discharge cuttings more efficiently.

Further, in the present embodiment, the discharge flow path 4 has the third flow path 43 extending in the tool axial direction, and the fluid flowing outward in the tool radial direction through the first flow path 41 flows to the rear end side of the bit body 2 through the third flow path 43. Since a decrease in the flow velocity of the fluid flowing toward the rear end side of the bit body 2 in the discharge flow path 4 is restrained, the force pushing out cuttings toward the rear end side is well maintained, and the dischargeability of cuttings is stably enhanced.

Further, in the present embodiment, as shown in FIG. 2, when viewed from the tool axial direction, the rotational trajectory (not shown) of the face tip 3A around the tool central axis O overlaps with at least a part of the blow hole 5. Alternatively, although not particularly shown, when viewed from the tool axial direction, the blow hole 5 is located inward in the tool radial direction from the rotational trajectory of the face tip 3A around the tool central axis O.

In this case, cuttings generated by the drilling of the face tip 3A easily flow outward in the tool radial direction because of the fluid flowing out from the blow hole 5. Therefore, the defect such as cuttings remaining at the tip of the bit is restrained.

As in the present embodiment, in a case where the rotational trajectory of the face tip 3A around the tool central axis O and the blow hole 5 overlap with each other, the face tip 3A restrains the fluid flowing out from the blow hole 5 from flowing into the tool circumferential direction immediately after the flow-out. Therefore, the fluid flowing from the blow hole 5 in the tool radial direction flows more stably, and the flow velocity of the fluid is increased.

Further, in the present embodiment, the gauge surface (bearing surface) 24*a* on which the gauge tip 3B is provided is located on the rear end side in the tool axial direction while extending toward one side (in the tool rotation direction T) in the tool circumferential direction, and the second flow path 42 is located on the gauge surface 24*a* and extends from the connection part with the first flow path 41 toward the other side in the tool circumferential direction (in the counter-tool rotation direction).

In this case, since the gauge surface 24*a* on which the gauge tip 3B is disposed also functions as the second flow path 42, the above-described effect of the present embodiment can be obtained while simplifying the structure of the tip surface 21 of the bit body 2.

Further, in the present embodiment, among the plurality of buttons 3, the tip central axis C of a predetermined button 3 adjacent to the first flow path 41 in the tool circumferential direction, specifically, a predetermined gauge tip 3B adjacent to the first flow path 41 in the counter-tool rotation direction, is away from the first flow path 41 in the tool circumferential direction while extending toward the rear end side in the tool axial direction.

In the present embodiment, as described above, there is a probability of premature wear in the vicinity of the first flow path 41 because the flow velocity of the fluid flowing through the first flow path 41 is increased. In that respect, the above configuration is employed, so that a large wall thickness is ensured between the predetermined button 3 (gauge tip 3B) adjacent to the first flow path 41 and the first flow path 41, and the button 3 is restrained from falling off from the bit body 2 because of the wear in the vicinity of the first flow path 41.

Further, in the present embodiment, the tip central axis C of the gauge tip 3B extends toward the opposite side of the tool rotation direction T in the tool circumferential direction while extending toward the rear end side in the tool axial direction.

In this case, during drilling, the gauge tip 3B can receive and relax a bending stress applied onto the gauge tip 3B due to the rotational force in the tool rotation direction T as a compressive stress in the tip axial direction. Therefore, breakage of the gauge tip 3B or the like is restrained.

Further, in the present embodiment, the radius of curvature of the impact edge 3*a* of the button 3 is less than ½ of the outer diameter (diameter) dimension of the part of the button 3 other than the tip part.

In this case, since the button 3 is a so-called spike tip or the like and the tip part of the button 3 is convexly formed, the drilling speed can be further increased. In addition, the button 3 has a sharp shape, so that a space for the fluid to flow in the vicinity of the tip part of the button 3 is ensured, and the dischargeability of cuttings can be further enhanced.

Further, in the present embodiment, the discharge flow path 4 has the fourth flow path 44 extending in the tool axial direction, and the fluid flowing through the second flow path 42 flows to the rear end side of the bit body 2 through the fourth flow path 44. Therefore, the dischargeability of cuttings can be further enhanced.

Further, in the present embodiment, the first flow path 41 has the flow velocity increasing part 41*b*, and the flow velocity increasing part 41*b* is disposed outward in the tool radial direction from the blow hole 5 and has a groove width that narrows while extending outward in the tool radial direction.

In this case, the fluid flowing out from the blow hole 5 into the first flow path 41 flows outward in the tool radial direction through the flow velocity increasing part 41*b*, so that the flow velocity is further increased. Therefore, the dischargeability of cuttings can be stably enhanced.

Further, in the present embodiment, the first flow path 41 has the flow rate increasing part 41*a*, the flow rate increasing part 41*a* has a groove width that widens while extending outward in the tool radial direction, and the blow hole 5 is open at the flow rate increasing part 41*a*.

In this case, the fluid immediately after flowing out from the blow hole 5 into the flow rate increasing part 41*a* tends to flow in a direction in which the groove width is wide, that is, outward in the tool radial direction. That is, since, in the fluid flowing out from the blow hole 5 into the flow rate increasing part 41*a*, a flow rate of a fluid flowing outward in the tool radial direction is larger than a flow rate of a fluid flowing inward in the tool radial direction, the fluid as a whole tends to flow outward in the tool radial direction. Therefore, the fluid in the first flow path 41 can stably flow outward in the tool radial direction, and the dischargeability of cuttings can be enhanced.

Further, in the present embodiment, the plurality of first flow paths 41 are provided side by side in the tool circumferential direction, and the plurality of first flow paths 41 are connected to each other via the inner end part of each first flow path 41 in the tool radial direction.

In this case, the dischargeability of cuttings can be stably enhanced even in the vicinity of the center part (on the tool central axis O) of the tip surface 21 of the bit body 2.

Further, in the present embodiment, the tip central axis C of the button 3 extends in a direction orthogonal to the front surface 23*a* or the gauge surface 24*a* on which each button 3 is disposed.

In this case, when the button 3 is worn out and re-grinding is performed, each of the bearing surfaces 23*a* and 24*a* can be used as a reference to accurately perform the re-grinding.

Other Configurations Included in Present Invention

It should be noted that the present invention is not limited to the above-described embodiment, and, for example, as will be described below, changes in configuration and the like can be made without departing from the gist of the present invention. In the drawings of the modification example, the same reference numerals are given to the same constituent elements as those of the above-described embodiment, and different points will be mainly described.

FIGS. 5 to 8 show a modification example of the drilling bit 1 described in the above-described embodiment. In this modification example, the discharge flow path 4 of the drilling bit 1 has a connection flow path 45 that is connected to the inner end parts of the plurality of first flow paths 41 in the tool radial direction. The connection flow path 45 has a recessed shape recessed from the tip surface 21 of the bit body 2 toward the rear end side in the tool axial direction, and is located on the tool central axis O. The connection flow path 45 allows the first flow paths 41 to communicate with each other.

Further, in this modification example, the front surface 23*a* is an inclined surface located on the rear end side in the tool axial direction while extending toward one side in the tool circumferential direction, that is, in the tool rotation direction T. The tip central axis C of the face tip 3A extends toward the opposite side of the tool rotation direction T in the tool circumferential direction while extending toward the rear end side in the tool axial direction.

In this case, during drilling, the face tip 3A can receive and relax a bending stress applied onto the face tip 3A due to the rotational force in the tool rotation direction T as a compressive stress in the tip axial direction. Therefore, breakage of the face tip 3A or the like is restrained.

Further, in this modification example, among the plurality of buttons 3, the tip central axis C of a predetermined face tip 3A adjacent to the first flow path 41 in the counter-tool rotation direction is away from the first flow path 41 in the counter-tool rotation direction while extending toward the rear end side in the tool axial direction. That is, the tip central axis C of a predetermined button 3 adjacent to the first flow path 41 in the tool circumferential direction is away from the first flow path 41 in the tool circumferential direction while extending toward the rear end side in the tool axial direction.

The above configuration is employed, so that a large wall thickness is ensured between the predetermined button 3 (face tip 3A) adjacent to the first flow path 41 and the first flow path 41, and the button 3 is restrained from falling off from the bit body 2 because of the wear in the vicinity of the first flow path 41.

In the above modification example, the second flow path 42 of the discharge flow path 4 may be located not only on the gauge surface 24*a* but also on a part (the outer end part in the tool radial direction) of the front surface 23*a*.

In the above-described embodiment, an example has been described in which one face tip 3A is disposed for one front surface 23*a* and one gauge tip 3B is disposed for one gauge surface 24*a*, but the present invention is not limited to this. A plurality of face tips 3A may be disposed for one front surface 23*a*, or a plurality of gauge tips 3B may be disposed for one gauge surface 24*a*.

In the above-described embodiment, an example has been described in which one side in the tool circumferential direction corresponds to the tool rotation direction T and the other side in the tool circumferential direction corresponds to the counter-tool rotation direction, but the present invention is not limited to this. One side in the tool circumferential direction may correspond to the counter-tool rotation direction, and the other side in the tool circumferential direction may correspond to the tool rotation direction T.

Further, in the above-described embodiment, an example has been described in which the button 3 is a spike tip, but the present invention is not limited to this. The button 3 may be, for example, a so-called ballistic tip having a cannonball-shaped tip part.

Further, a configuration has been described in which, in the vertical cross-sectional view of the button 3 including the tip central axis C, the radius of curvature of the impact edge 3*a* is less than ½ of the outer diameter dimension of the button 3, but, for example, in a cross-sectional view inclined with respect to the tip central axis C, the radius of curvature of the impact edge 3*a* may be less than ½ of the outer diameter dimension of the button 3.

The present invention may combine the configurations described in the above-described embodiment, modification example, and the like without departing from the gist of the present invention, and addition, omission, replacement, and other changes to the configuration are possible. Further, the present invention is not limited by the above-described embodiment and the like, and is limited only by the scope of the claims.

INDUSTRIAL APPLICABILITY

With the drilling bit of the present invention, it is possible to efficiently discharge cuttings while supplying the fluid to a wide range of the tip surface of the bit body. Therefore, the present invention has industrial applicability.

REFERENCE SIGNS LIST

1: Drilling bit
2: Bit body
3: Button
3A: Face tip
3B: Gauge tip
3*a*: Impact edge
4: Discharge flow path
5: Blow hole
21: Tip surface
22: Outer peripheral surface
23: Front surface
24: Gauge surface
24*a*: Gauge surface (bearing surface)
41: First flow path
41*a*: Flow rate increasing part
41*b*: Flow velocity increasing part
42: Second flow path
43: Third flow path
44: Fourth flow path
C: Tip central axis
O: Tool central axis
T: Tool rotation direction

What is claimed is:

1. A drilling bit comprising:
a bit body centered on a tool central axis;
a plurality of buttons protruding from a tip surface of the bit body;
a discharge flow path disposed from the tip surface of the bit body over an outer peripheral surface; and
a blow hole that extends inside the bit body and is open at the tip surface,
wherein the discharge flow path has
a first flow path which has a groove shape located on the tip surface and extending in a tool radial direction, and at which the blow hole is open, and
a second flow path located outward in the tool radial direction from the blow hole on the tip surface to communicate with the first flow path, and extending in a tool circumferential direction,
the first flow path has a flow velocity increasing part that is disposed outward in the tool radial direction from the blow hole and extends outward in the tool radial direction,
the flow velocity increasing part has a pair of groove walls facing each other in the tool circumferential direction,
among the pair of groove walls, a height in a tool axial direction of one groove wall that is located at an end part of the flow velocity increasing part in a counter-tool rotation direction to face a tool rotation direction is lower than a height in the tool axial direction of the other groove wall that is located at an end part of the flow velocity increasing part in the tool rotation direction to face the counter-tool rotation direction, and
the pair of groove walls are configured so that some of the fluid flowing through the flow velocity increasing part flows over the one groove wall into the second flow path adjacent to the flow velocity increasing part in the counter-tool rotation direction.

2. The drilling bit according to claim 1,
wherein the second flow path extends from a connection part with the first flow path toward at least an opposite side of a tool rotation direction in the tool circumferential direction.

3. The drilling bit according to claim 1,
wherein the discharge flow path has a third flow path that has a groove shape located on the outer peripheral surface and extending in the tool axial direction, and that is connected to an outer end part of the first flow path in the tool radial direction.

4. The drilling bit according to claim 1,
wherein the tip surface has
a face surface facing a tip side in the tool axial direction, and
a gauge surface that is disposed outward in the tool radial direction from the face surface, and that is located on a rear end side in the tool axial direction while extending outward in the tool radial direction,
the plurality of buttons include
a face tip disposed on the face surface, and
a gauge tip disposed on the gauge surface, and
the blow hole is located inward in the tool radial direction or overlaps with respect to a rotational trajectory of the face tip around the tool central axis when viewed from the tool axial direction.

5. The drilling bit according to claim 1,
wherein the tip surface has
a face surface facing a tip side in the tool axial direction, and
a gauge surface that is disposed outward in the tool radial direction from the face surface, and that is located on a rear end side in the tool axial direction while extending outward in the tool radial direction,
the plurality of buttons include
a face tip disposed on the face surface, and
a plurality of gauge tips disposed on the gauge surface,
the gauge surface has a plurality of bearing surfaces arranged in the tool circumferential direction,
the gauge tip is provided on each of the bearing surfaces,
the bearing surface is located on the rear end side in the tool axial direction while extending toward one side in the tool circumferential direction, and
the second flow path is located on the bearing surface and extends from a connection part with the first flow path toward the other side in the tool circumferential direction.

6. The drilling bit according to claim 1,
wherein, among the plurality of the buttons, a tip central axis of a predetermined button adjacent to the first flow path in the tool circumferential direction is away from the first flow path in the tool circumferential direction while extending toward a rear end side in the tool axial direction.

7. The drilling bit according to claim 1,
wherein the tip surface has
a face surface facing a tip side in the tool axial direction, and a gauge surface that is disposed outward in the tool radial direction from the face surface, and that is located on a rear end side in the tool axial direction while extending outward in the tool radial direction, the plurality of buttons include a face tip disposed on the face surface, and a gauge tip disposed on the gauge surface, and a tip central axis of the gauge tip extends toward an opposite side of the tool rotation direction in the tool circumferential direction while extending toward the rear end side in the tool axial direction.

8. The drilling bit according to claim 1, wherein the tip surface has a face surface facing a tip side in the tool axial direction, and a gauge surface that is disposed outward in the tool radial direction from the face surface, and that is located on a rear end side in the tool axial direction while extending outward in the tool radial direction, the plurality of buttons include a face tip disposed on the face surface, and a gauge tip disposed on the gauge surface, and a tip central axis of the face tip extends toward an opposite side of the tool rotation direction in the tool circumferential direction while extending toward the rear end side in the tool axial direction.

9. The drilling bit according to claim 1, wherein the button has a convexly curved impact edge disposed at a tip part in a tip axial direction, and a radius of curvature of the impact edge is less than ½ of an outer diameter dimension of the button.

10. The drilling bit according to claim 1, wherein the discharge flow path has a fourth flow path that has a groove shape located on the outer peripheral surface and extending in the tool axial direction, and that communicates with the second flow path.

11. The drilling bit according to claim 1, wherein the flow velocity increasing part has a groove width which narrows while extending outward in the tool radial direction.

12. The drilling bit according to claim 1, wherein the first flow path has a flow rate increasing part that has a groove width which widens while extending outward in the tool radial direction, and the blow hole is open at the flow rate increasing part.

13. The drilling bit according to claim 1, wherein a plurality of the first flow paths are provided side by side in the tool circumferential direction, and the plurality of first flow paths are connected to each other via an inner end part of each of the first flow paths in the tool radial direction.

* * * * *